US011333306B2

(12) United States Patent
Li et al.

(10) Patent No.: US 11,333,306 B2
(45) Date of Patent: May 17, 2022

(54) LIGHT BULB APPARATUS

(71) Applicant: XIAMEN ECO LIGHTING CO. LTD., Xiamen (CN)

(72) Inventors: Guochao Li, Xiamen (CN); Yongjun Bao, Xiamen (CN); Shengliang Huang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 17/110,029

(22) Filed: Dec. 2, 2020

(65) Prior Publication Data

US 2021/0102670 A1 Apr. 8, 2021

Related U.S. Application Data

(63) Continuation of application No. 16/860,307, filed on Apr. 28, 2020, now Pat. No. 10,883,668.

(30) Foreign Application Priority Data

May 23, 2019 (CN) ..... 201920753512.3

(51) Int. Cl.

| | |
|---|---|
| ***F21K 9/235*** | (2016.01) |
| ***F21V 29/70*** | (2015.01) |
| ***F21K 9/238*** | (2016.01) |
| ***F21K 9/232*** | (2016.01) |
| ***F21K 9/237*** | (2016.01) |
| ***F21V 23/00*** | (2015.01) |

(52) U.S. Cl.

CPC ..... *F21K 9/235* (2016.08); *F21K 9/232* (2016.08); *F21K 9/237* (2016.08); *F21K 9/238* (2016.08); *F21V 23/002* (2013.01); *F21V 23/003* (2013.01); *F21V 29/70* (2015.01)

(58) Field of Classification Search

CPC ..... F21K 9/232; F21K 9/235; F21K 9/237; F21K 9/238; F21V 29/70; F21V 23/002; F21V 23/003

See application file for complete search history.

(56) References Cited

U.S. PATENT DOCUMENTS

| | | | | |
|---|---|---|---|---|
| 2015/0062928 | A1* | 3/2015 | Mostoller | F21K 9/23 362/363 |
| 2015/0062929 | A1* | 3/2015 | Mostoller | F21K 9/235 362/363 |
| 2017/0227167 | A1* | 8/2017 | Lai | F21K 9/232 |
| 2018/0350584 | A1* | 12/2018 | Fu | H01K 1/42 |

* cited by examiner

*Primary Examiner* — Thomas M Sember
(74) *Attorney, Agent, or Firm* — Chun-Ming Shih; Lanway IPR Services

(57) ABSTRACT

A light bulb apparatus includes a bulb shell, a light source module, a bulb head, a bottom pin and a driver module. The bulb shell has a light passing cover and a neck portion. The bulb head has a body portion and an Edison cap. A bottom pin is used for connecting a second electrode of the Edison socket. The driver module is enclosed by the bulb head. The driver module has a driver plate mounted with a driver component and a driver input terminal. The driver input terminal has a guiding groove. The driver input terminal has a first wiring clip, the bottom pin is inserted into the guiding groove via the entrance and engages the first wiring clip for electrically connected to the driver component.

19 Claims, 11 Drawing Sheets

LIGHT BULB APPARATUS

RELATED APPLICATION

The present application is a continued application of U.S. patent application Ser. No. 16/860,307.

FIELD

The present application is related to a lighting apparatus and more particularly related to an LED lighting apparatus.

BACKGROUND

Electroluminescence, an optical and electrical phenomenon, was discovered in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

It is also important to consider how to conveniently install a lighting apparatus. Particularly, many societies face aging problems. More and more old people need to replace or install lighting devices by themselves. Labor cost for installing lighting devices is also increasing. It is therefore beneficial to design a better way to install various lighting devices.

In some applications, it is important to project a light on an object or an area to emphasize the object or the area.

Light bulbs are widely used since Edison released his light bulbs. Today, more and more light bulbs use LED modules as light sources. There are many problems to solve and advantages to discover when converting to LED technology to design light bulbs.

It is challenging and beneficial to design a better light bulb with easier assembly and lower manufacturing cost.

SUMMARY

In some embodiments, a light bulb apparatus, includes a bulb shell, a light source module, a bulb head, a bottom pin and a driver module.

The bulb shell has a light passing cover and a neck portion. The bulb head has a body portion and an Edison cap. The body portion is connected to the neck portion for enclosing the light source module. The light source module emits a light passing the light passing cover. The Edison cap has a conductive screw wall for connecting to a first electrode of an Edison socket. A bottom pin is used for connecting a second electrode of the Edison socket.

The driver module is enclosed by the bulb head. The driver module has a driver plate mounted with a driver component and a driver input terminal. The driver input terminal has a guiding groove. The guiding groove has an entrance end leading to the guiding groove. The entrance has a larger opening than a diameter of the guiding groove. The driver input terminal has a first wiring clip, the bottom pin is inserted into the guiding groove via the entrance and engages the first wiring clip for electrically connected to the driver component.

In some embodiments, the guiding groove has a bottom wall, a first lateral wall and a second lateral wall, the first lateral wall and the second lateral wall are respectively extended from the bottom wall forming the guiding groove.

In some embodiments, the first wiring clip fixed to the first lateral wall has a first extending portion placed in the guiding groove, an engaging portion is extended and bent from the first extending portion toward the second lateral wall, the first extending portion, the second lateral wall and the bottom wall together form a position limiting ring for the bottom pin.

In some embodiments, an exit end is at an opposite side of the guiding groove with respect to the entrance end, a diameter of the guiding groove is gradually decreased from the entrance end to the exit end.

In some embodiments, the driver input terminal has a second wiring clip. The second wiring clip is fixed to the second lateral wall. The second wiring clip has a second extending portion engages the conductive screw wall for electrically connecting the conductive screw wall to the driver component.

In some embodiments, the bottom pin has an elastic reverse hook fixed to an end of the engaging portion.

In some embodiments, the driver plate is inserted into a guiding groove of the bulb head, the driver plate is fixed to the bulb head with the elastic revere hook and the guiding grooved.

In some embodiments, the neck portion includes a heat insulation belt on for a user to hold and release the light bulb apparatus from the Edison socket.

In some embodiments, the body portion of the bulb head includes a heat insulation belt for a user to hold and release the light bulb apparatus from the Edison socket.

In some embodiments, the light source module includes multiple filament, each filament is mounted with multiple LED modules.

In some embodiments, bottom ends of the multiple filaments form a larger area than top ends of the multiple filaments, the bottom ends are closer to the bulb head than the top ends.

In some embodiments, the top ends of the multiple filaments are fixed together.

In some embodiments, the light source module includes multiple flexible filaments having multiple optical parameters.

In some embodiments, the multiple flexible filaments are bent and twisted together.

In some embodiments, the bulb head has a first portion and a second portion. The first portion is rotatable with respect to the second portion for change a setting for the driver component to control the light source module according to the setting.

In some embodiments, an electric converter is placed in the first portion and a wireless circuit is placed in the second portion.

In some embodiments, an electric converter is placed in the first portion and a wireless circuit is placed in the second portion.

In some embodiments, the light source module includes a light source plate plugged to the driver plate with metal pins.

In some embodiments, the light source plate has elastic clips for fixing the metal pins of the driver plate.

In some embodiments, the driver plate is connected to heat conductive strip to transmit heat to the bulb head.

DETAILED DESCRIPTION

Figure 1:
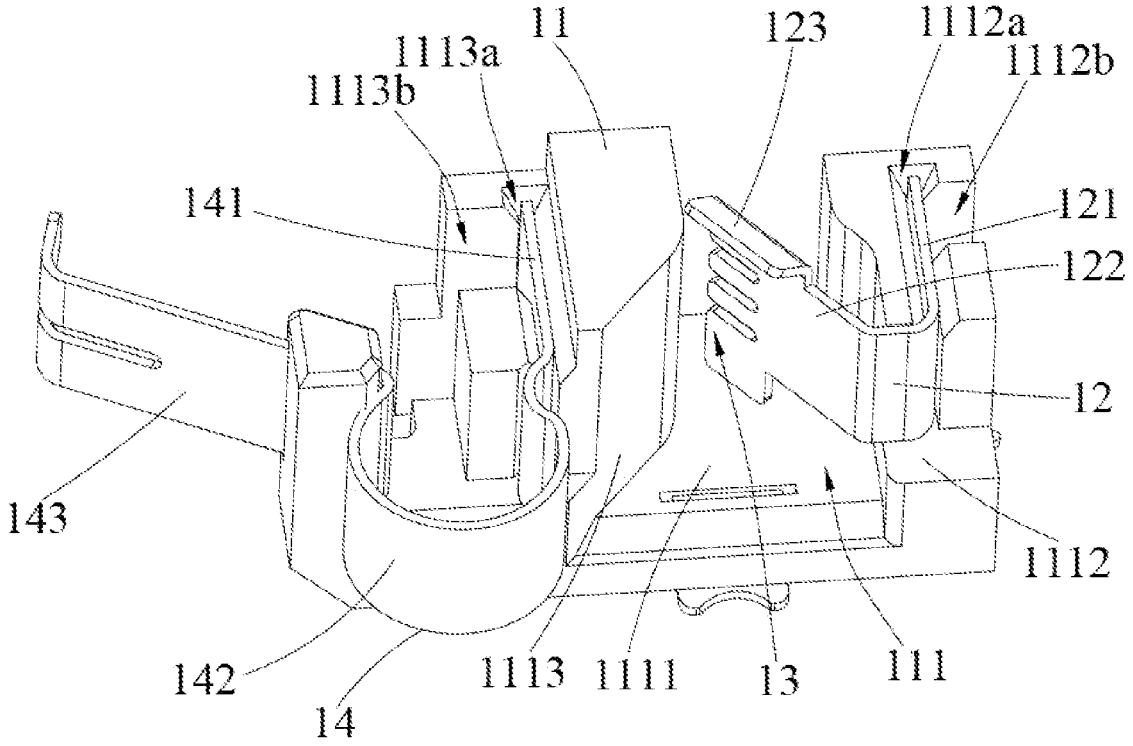
FIG. 1 illustrates a connector component.

Please refer to FIG. 1, FIG. 2, FIG. 3 and FIG. 7, which illustrate a light bulb apparatus embodiment and its components.

In some embodiments, a light bulb apparatus includes a driver input terminal. The driver input terminal has a housing 11. There is a guiding groove 111 for inserting a bottom pin 7. The guiding groove 111 includes a bottom wall 1111, a first lateral wall 1112 and a second lateral wall 1113.

The driver input terminal also includes a first wiring clip 12 fixed to the first lateral wall 1112. The first wiring clip 12 has an extending portion extending into the guiding groove 111. The first extending portion 122 has an engaging portion 123 extended from the first extending portion 122 and bent toward the second lateral wall 1113. The engaging portion 123, the first extending portion 122, the second lateral wall 1113 and the bottom wall 111 together form a position limiting ring for the bottom pin 7.

The driver input terminal has a housing 11. The housing has a guiding groove 111 for connecting the bottom pin 7.

The guiding groove 111 has a bottom wall 1111, a first lateral wall 1112 and a second lateral wall 1113. The first lateral wall 1112 and the second lateral wall 1113 are extended from the bottom wall 1111.

The driver input terminal also includes a first wiring clip 12 fixed to the first lateral wall 1112. The first wiring clip 12 has a first extending portion 122 extended into the guiding groove 111. An engaging portion 123 is extended from the first extending portion 122 and bent toward the second lateral wall 1113.

The cost of the driver input terminal is not increased and assembling of the light bulb apparatus is also simple.

The engaging portion 123, the first extending portion 122, the second lateral wall 1113 and the bottom wall 1111 together form a position limiting ring 13 for connecting the bottom pin 7

The position limiting ring 13 ensures the bottom pin is not skewed when inserting into the bulb head. Such skewed connection may cause safety issues or product quality problems.

Specifically, the bottom pin is inserted into an entrance end of the guiding groove. The opposite end for the entrance end of the guiding groove is an exit end. The diameter of the guiding groove is gradually decreased from the entrance end to the exit end.

The entrance end of the guiding groove 111 is larger and the diameter is decreased gradually to the exit end. Therefore, the bottom pin 7 is guided smoothly to engage the engaging portion of the first extension portion. Such arrangement prevents skew or bent of the bottom pin 7. The diameter of the guiding groove refers to a distance between the first lateral wall 1112 and the second lateral wall 1113.

The first wiring clip also includes a first fixing portion 121 disposed on the first lateral wall 1112. The first fixing portion 121 is bent toward a direction of the second lateral wall 1113 and enters the guiding groove 111 forming a first extending portion 122.

The first extending portion 122 has a tilt angle and is disposed in the guiding groove 111 making a distance between the second lateral wall 1113 and the first extending portion 122 decreasing gradually from the entrance end of the guiding groove 111.

When the bottom pin is inserted into the guiding groove 111 to engage the engaging the first extending portion 122, the first extending portion 122 is gradually pushed more and more by the bottom pin 7 so that the first extending portion 121 is closer to the first fixing portion 121. Finally, the bottom pin 7 is stably fixed between the first extending portion 122 and the second lateral wall 1113.

In some embodiments, the first lateral wall 1112 has a first buckle groove 1112*a* at a position corresponding to the first fixing portion 121. The first fixing portion 121 is bucked in the first buckle groove 1112*a* so as to place the first wiring clip 12 on the first lateral wall 1112.

Please be noted that in some other embodiments, the first wiring clip 12 may be placed on the first lateral wall with other ways and the example illustrated here is not a limitation for the invention scope.

In some embodiments, the first fixing portion 121 has an end away from the second lateral wall being bent as a first welding pin 124. There is a positioning groove 1112*b* disposed corresponding to the first welding pin 124. The first positioning groove 1112*b* is connected to the first buckle groove 1112*a*. The first welding pin 124 is exposed at a bottom of the first positioning groove 1112*b* so that the first welding pin 124 may be welded to a driver plate 4 for performing an electrical connection between the first wiring clip 12 and the driver plate 4.

In some embodiments, wire welding or other connection methods may be used for electrically connecting the first wiring clip 12 to the driver plate 4.

In some embodiments, the driver input terminal also includes a second wiring clip 14 fixed to the second lateral wall 1113. The second wiring 14 is used for electrically connecting the driver plate 4 to a screw wall 6 of an Edison cap.

The second wiring clip 14 includes a second fixing portion 141 on the second lateral wall 1113, a bending portion 142 with an end connected to the second fixing portion 141, and a second extending portion 143 away from the bent portion 142 and connected to the second fixing portion 141. An end of the second fixing portion 141 is bent toward the first lateral wall 1112 to form a second welding pin 144.

The second extending portion 143 is used for engaging the screw wall 6 of an Edison cap.

The second welding pin 144 is welded on the driver plate 4 for electrically connecting the screw wall 6 of the Edison cap connecting to the driver plate 4.

In some embodiments, there is a second buckle groove 1113*a* corresponding to the second fixing portion 141. The second fixing portion 141 is disposed in the second buckle groove 1113*a*.

There is a second positioning groove 1113*b* on the second lateral wall 1113 corresponding to the second welding pin 144. The second positioning groove 1113*b* is connected to the second buckle groove 1113*a*. The second welding pin 144 is exposed at a bottom of the second positioning groove for the second welding pin 144 is welded on the driver plate 4.

Figure 2:
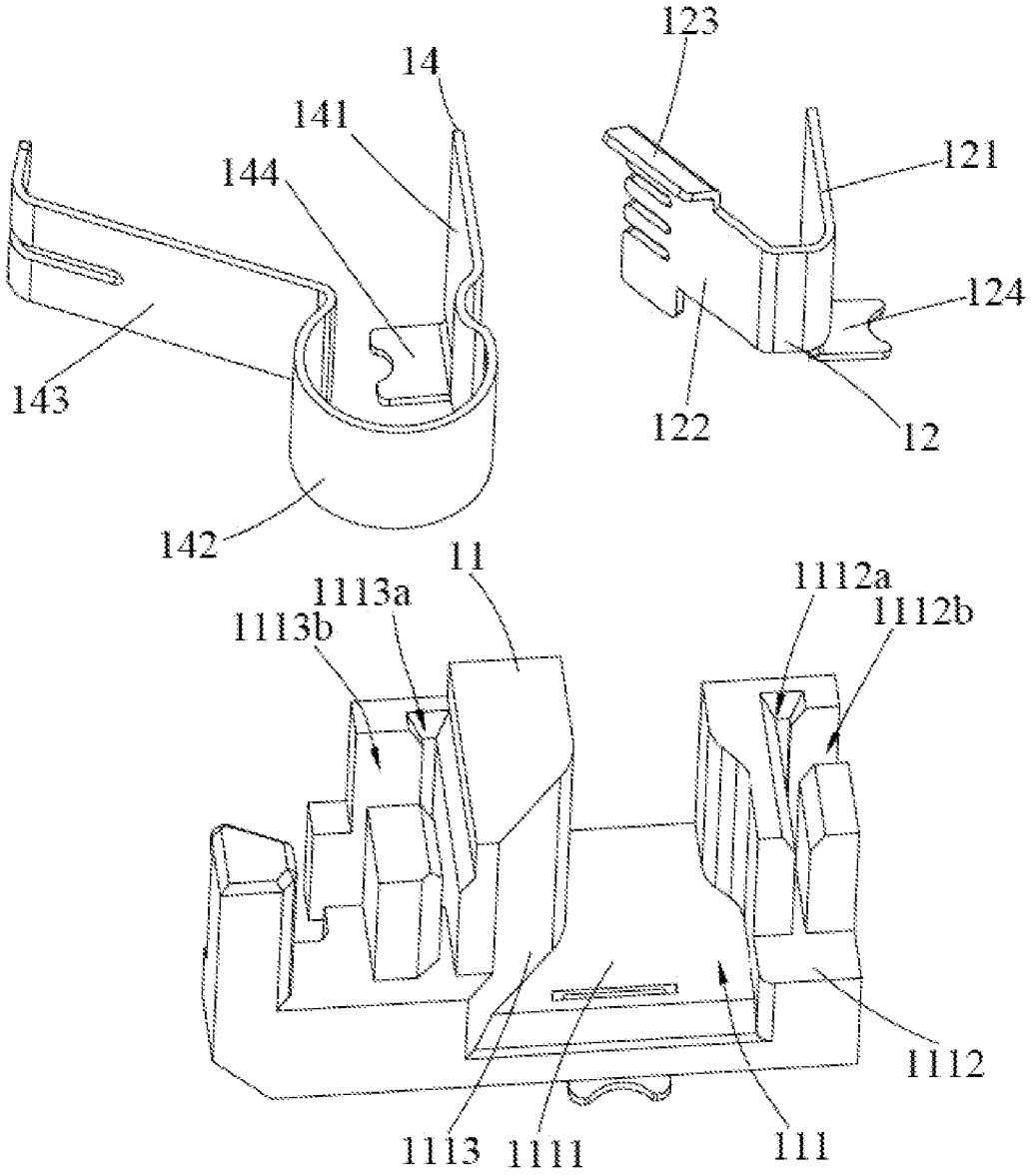
FIG. 2 illustrates an exploded view of the connector component.
Figure 3:
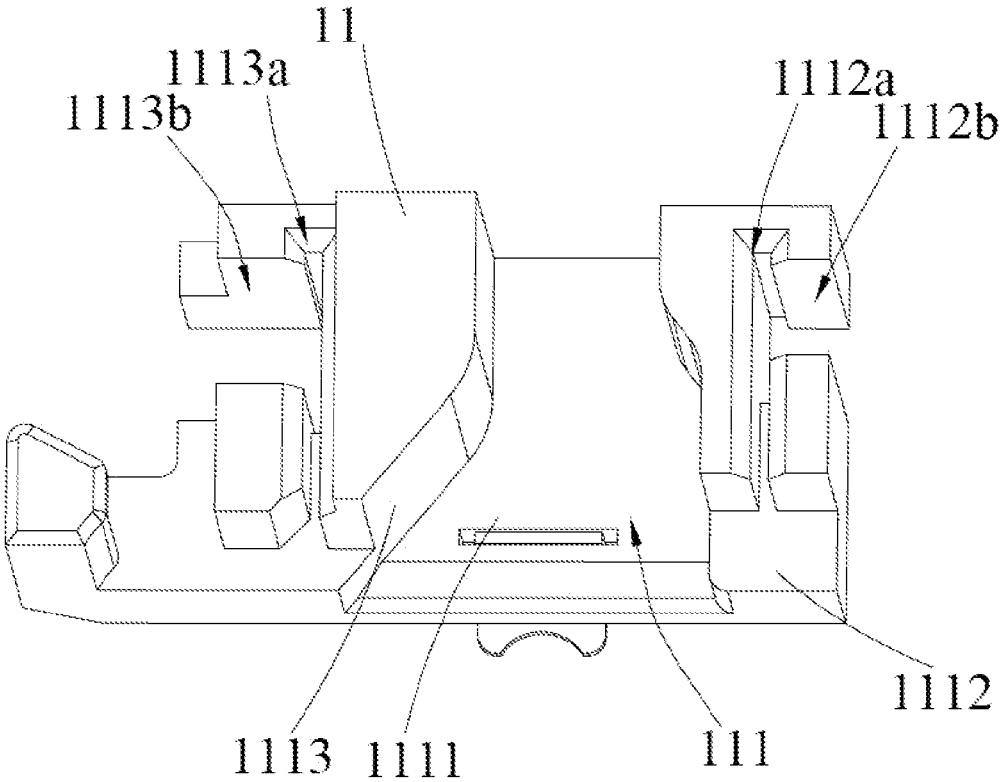
FIG. 3 illustrates a component.
Figure 4:
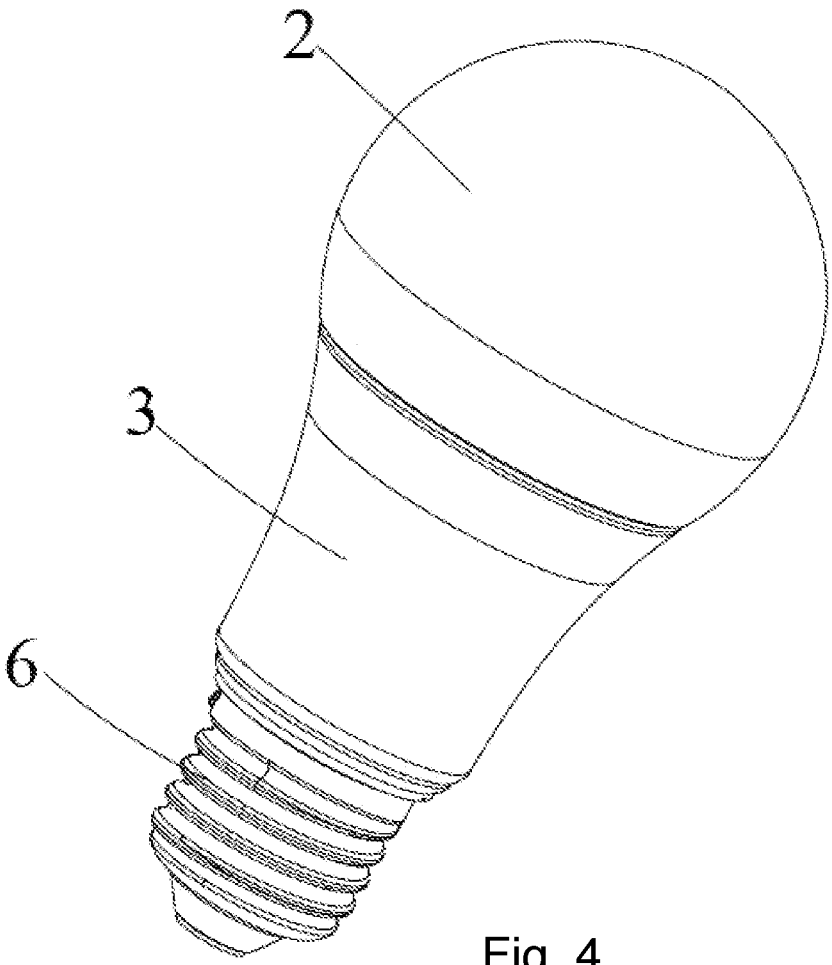
FIG. 4 illustrates a light bulb example.
Figure 5:
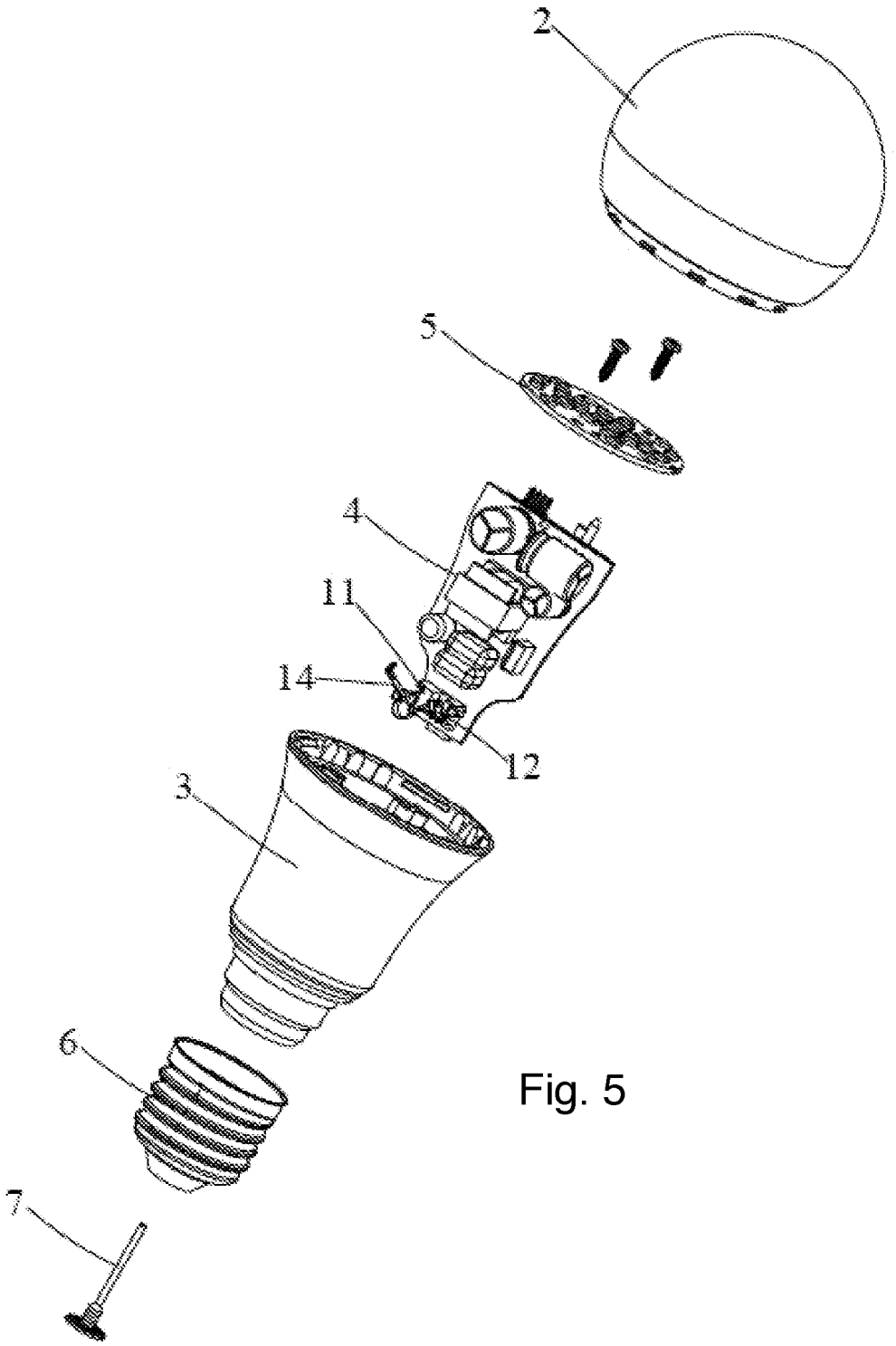
FIG. 5 illustrates an exploded view of the light bulb example in FIG. 4.
Figure 6:
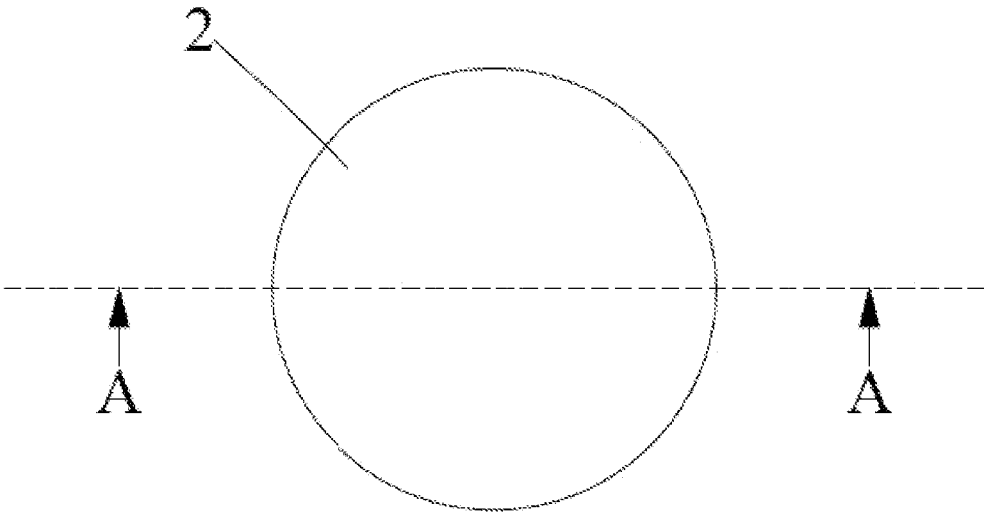
FIG. 6 illustrates a top view of the example.
Figure 7:
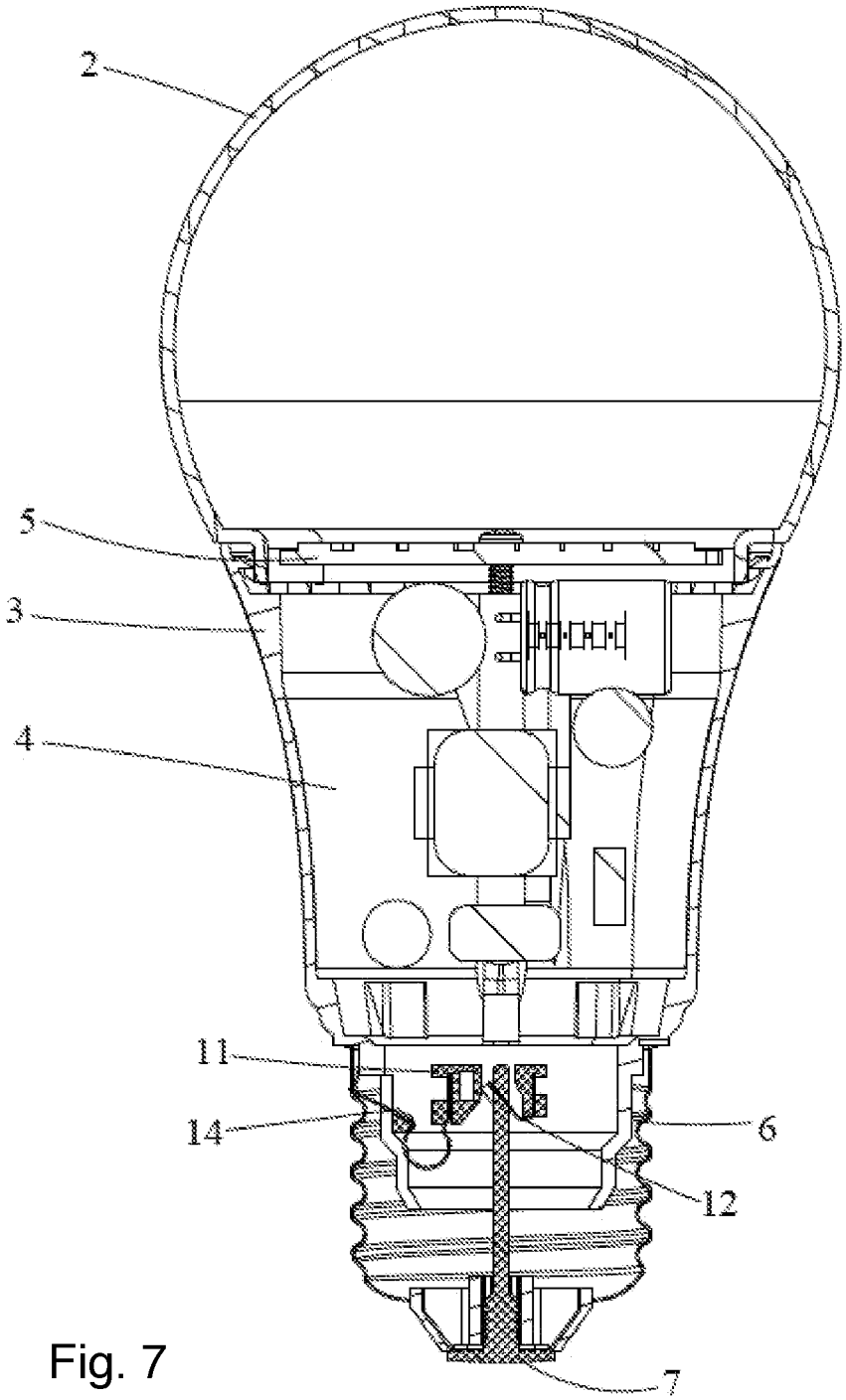
FIG. 7 illustrates a cross-sectional view of the example.

Please refer to FIG. 4, FIG. 5, FIG. 6 and FIG. 7 in view of FIG. 1, FIG. 2 and FIG. 3.

In some embodiments, the light bulb apparatus includes a heat sink piece 3 and a light source plate 5. A bulb shell 2 connected to the heat sink piece 3. A bulb head 6 connected to the heat sink piece 3. A bottom pin 7 is inserted into the bulb head 6. A driver plate 4 has a housing 11, a first wiring clip 12 and a second wiring clip 14.

Figure 8:
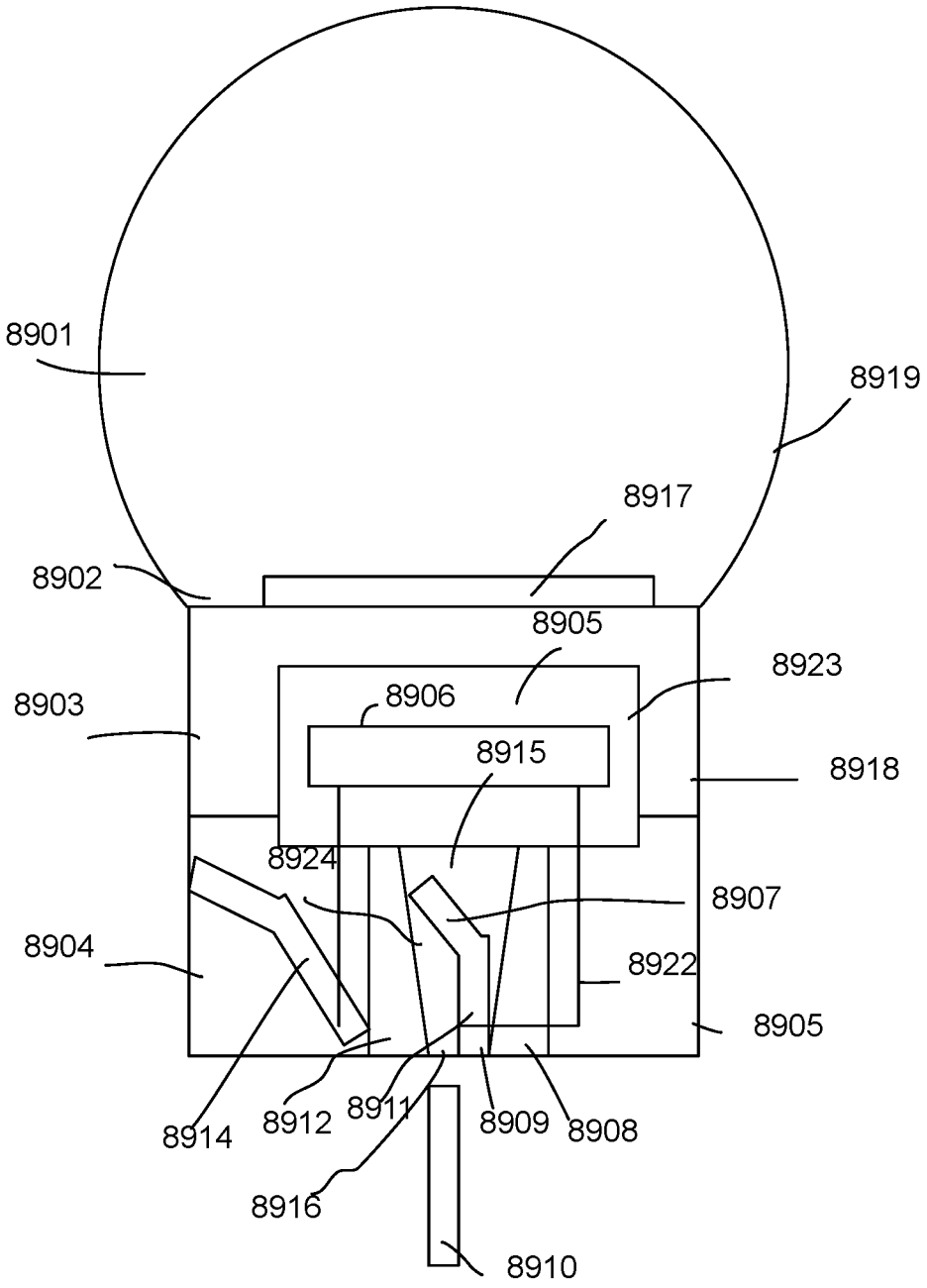
FIG. 8 illustrates a structural view of an embodiment.

In FIG. 8, a light bulb apparatus includes a bulb shell 8901, a light source module 8917, a bulb head 8918, a bottom pin 8910 and a driver module 8905.

The bulb shell 8919 has a light passing cover 8901 and a neck portion 8902. The bulb head 8918 has a body portion 8903 and an Edison cap 8904. The body portion 8903 is connected to the neck portion 8902 for enclosing the light source module 8917. The light source module 8917 emits a light passing the light passing cover 8901. The Edison cap 8904 has a conductive screw wall 8905 for connecting to a first electrode of an Edison socket (not shown, a standard Edison socket). A bottom pin 8910 is used for connecting a second electrode of the Edison socket.

The driver module 8905 is enclosed by the bulb head 8918. The driver module 8905 has a driver plate 8923 mounted with a driver component 8906 and a driver input terminal 8922. The driver input terminal 8922 has a guiding groove 8924. The guiding groove 8924 has an entrance end 8916 leading to the guiding groove 8924. The entrance end 8916 has a larger opening than a diameter of the guiding groove 8924. The driver input terminal 8922 has a first wiring clip 8911, the bottom pin 8910 is inserted into the guiding groove 8916 via the entrance end 8916 and engages the first wiring clip 8911 for electrically connected to the driver component 8906.

In some embodiments, the guiding groove has a bottom wall, a first lateral wall and a second lateral wall as illustrated in previous examples. The first lateral wall and the second lateral wall are respectively extended from the bottom wall forming the guiding groove.

In some embodiments, the first wiring clip fixed to the first lateral wall has a first extending portion placed in the guiding groove as illustrated in previous example. An engaging portion is extended and bent from the first extending portion toward the second lateral wall, the first extending portion, the second lateral wall and the bottom wall together form a position limiting ring for the bottom pin.

In some embodiments, an exit end is at an opposite side of the guiding groove with respect to the entrance end, a diameter of the guiding groove is gradually decreased from the entrance end to the exit end.

In some embodiments, the driver input terminal has a second wiring clip, the second wiring clip is fixed to the second lateral wall, the second wiring clip has a second extending portion engages the conductive screw wall for electrically connecting the conductive screw wall to the driver component.

In some embodiments, the bottom pin has an elastic reverse hook fixed to an end of the engaging portion.

In some embodiments, the driver plate is inserted into a guiding groove of the bulb head, the driver plate is fixed to the bulb head with the elastic revere hook and the guiding grooved.

Figure 9:
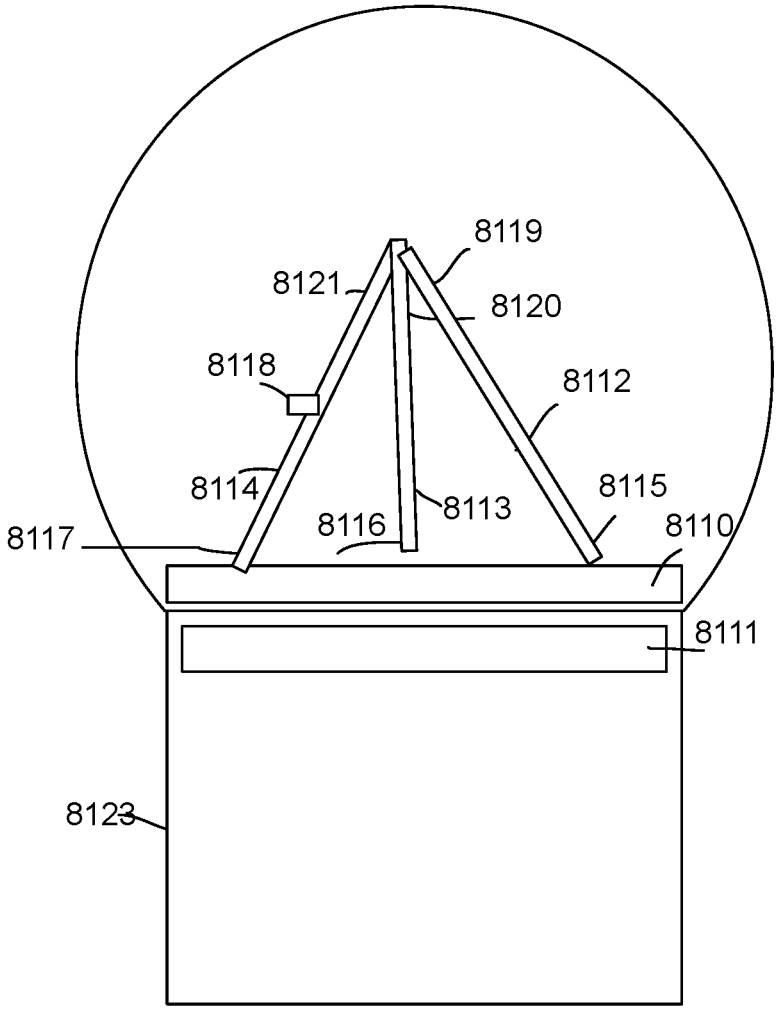
FIG. 9 illustrates another embodiment.

In FIG. 9, the neck portion includes a heat insulation belt 8110 on for a user to hold and release the light bulb apparatus from the Edison socket.

In FIG. 9, the body portion of the bulb head includes a heat insulation belt 8111 for a user to hold and release the light bulb apparatus from the Edison socket.

Such arrangement makes it safer when changing light bulbs.

In FIG. 9, the light source module includes multiple filament 8112, 8113, 8114, each filament 8114 is mounted with multiple LED modules 8118.

In FIG. 9, bottom ends 8115, 8116, 8117 of the multiple filaments 8112, 8113, 8114 form a larger area than top ends 8119, 8120, 8121 of the multiple filaments 8112, 8113, 8114. The bottom ends 8115, 8116, 8117 are closer to the bulb head 8123 than the top ends 8119, 8120, 8121.

In FIG. 9, the top ends 8119, 8120, 8121 of the multiple filaments 8112, 8113, 8114 are fixed together.

Figure 10:
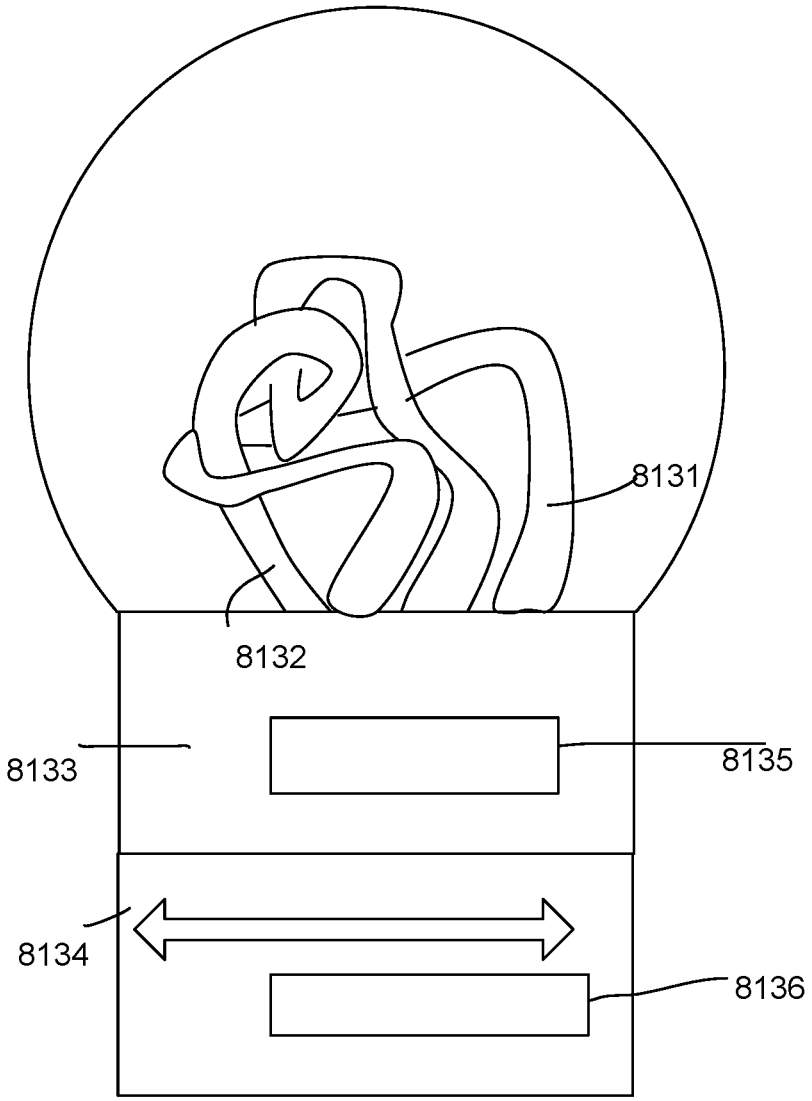
FIG. 10 illustrates another embodiment.

In FIG. 10, the light source module includes multiple flexible filaments 8131, 8132 having multiple optical parameters.

In FIG. 10, the multiple flexible filaments 8131, 8132 are bent and twisted together.

In FIG. 10, the bulb head has a first portion 8133 and a second portion 8134. The first portion 8133 is rotatable with respect to the second portion 8134 for change a setting for the driver component to control the light source module according to the setting.

In FIG. 10, an electric converter 8135 is placed in the first portion 8133 and a wireless circuit 8136 is placed in the second portion 8134.

Figure 11:
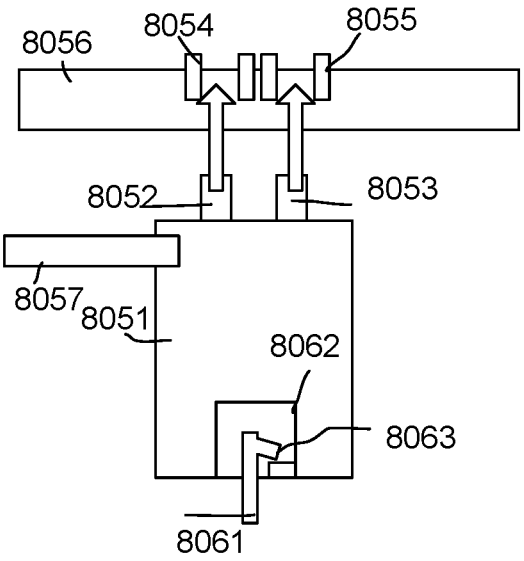
FIG. 11 illustrates another embodiment.

In FIG. 11, the bottom pin 8061 has a reversed hook 8063 for fixing to the driver input terminal 8062 when the bottom pin 8061 is inserted.

In FIG. 11, the light source module includes a light source plate 8051 plugged to the driver plate with metal pins 8052, 8053.

In FIG. 11, the light source plate 8056 has elastic clips 8054, 8055 for fixing the metal pins 8052, 8053 of the driver plate.

In FIG. 11, the driver plate 8051 is connected to heat conductive strip 8057 to transmit heat to the bulb head.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A light bulb apparatus, comprising:

a bulb shell having a light passing cover and a neck portion;

a light source module, wherein the light source module comprises multiple filaments, each filament is mounted with multiple LED modules;

a bulb head having a body portion and an Edison cap, the body portion being connected to the neck portion for enclosing the light source module, the light source module emitting a light passing the light passing cover, the Edison cap having a conductive screw wall for connecting to a first electrode of an Edison socket;

a bottom pin for connecting a second electrode of the Edison socket; and a driver module enclosed by the bulb head, the driver module having a driver plate mounted with a driver component and a driver input terminal, wherein the driver input terminal has a first wring clip, the bottom pin is inserted into the bulb head to engage the first wiring clip for electrically connecting to the driver component, wherein the driver input terminal has a guiding groove, the guiding groove having an entrance end leading to the guiding groove, the entrance has a larger opening than a diameter of the guiding groove, the first wiring clip is disposed on the driver input terminal, the bottom pin is inserted into the guiding groove via the entrance and engages the first wiring clip for electrically connecting to the driver component.

2. The light bulb apparatus of claim 1, wherein the guiding groove has a bottom wall, a first lateral wall and a second lateral wall, the first lateral wall and the second lateral wall are respectively extended from the bottom wall forming the guiding groove.

3. The light bulb apparatus of claim 1, wherein the first wiring clip fixed to the first lateral wall has a first extending portion placed in the guiding groove, an engaging portion is extended and bent from the first extending portion toward the second lateral wall, the first extending portion, the second lateral wall and the bottom wall together form a position limiting ring for the bottom pin.

4. The light bulb apparatus of claim 1, wherein an exit end is at an opposite side of the guiding groove with respect to the entrance end, a diameter of the guiding groove is gradually decreased from the entrance end to the exit end.

5. The light bulb apparatus of claim 1, wherein the driver input terminal has a second wiring clip, the second wiring clip is fixed to the second lateral wall, the second wiring clip has a second extending portion engages the conductive screw wall for electrically connecting the conductive screw wall to the driver component.

6. The light bulb apparatus of claim 1, wherein the bottom pin has an elastic reverse hook fixed to an end of the engaging portion.

7. The light bulb apparatus of claim 6, wherein the driver plate is inserted into a guiding groove of the bulb head, the driver plate is fixed to the bulb head with the elastic revere hook and the guiding grooved.

8. The light bulb apparatus of claim 1, wherein the neck portion comprises a heat insulation belt on for a user to hold and release the light bulb apparatus from the Edison socket.

9. The light bulb apparatus of claim 1, wherein the body portion of the bulb head comprises a heat insulation belt for a user to hold and release the light bulb apparatus from the Edison socket.

10. The light bulb apparatus of claim 1, wherein bottom ends of the multiple filaments form a larger area than top ends of the multiple filaments, the bottom ends are closer to the bulb head than the top ends.

11. The light bulb apparatus of claim 1, wherein the top ends of the multiple filaments are fixed together.

12. The light bulb apparatus of claim 1, wherein the multiple filaments are multiple flexible filaments with multiple optical parameters.

13. The light bulb apparatus of claim 12, wherein the multiple flexible filaments are bent and twisted together.

14. The light bulb apparatus of claim 1, wherein the bulb head has a first portion and a second portion, the first portion is rotatable with respect to the second portion for change a setting for the driver component to control the light source module according to the setting.

15. The light bulb apparatus of claim 14, wherein an electric converter is placed in the first portion and a wireless circuit is placed in the second portion.

16. The light bulb apparatus of claim 1, wherein the bottom pin has a reversed hook for fixing to the driver input terminal when the bottom pin is inserted.

17. The light bulb apparatus of claim 1, wherein the light source module comprises a light source plate plugged to the driver plate with metal pins.

18. The light bulb apparatus of claim 17, wherein the light source plate has elastic clips for fixing the metal pins of the driver plate.

19. The light bulb apparatus of claim 17, wherein the driver plate is connected to heat conductive strip to transmit heat to the bulb head.

* * * * *